US007784319B2

(12) United States Patent
Saville

(10) Patent No.: US 7,784,319 B2
(45) Date of Patent: Aug. 31, 2010

(54) SYSTEMS AND METHODS FOR MONITORING AND CONTROLLING A CAN NECKING PROCESS

(75) Inventor: Benjamin Lee Saville, West Yorkshire (GB)

(73) Assignee: Crown, Packaging Technology, Inc, Alsip, IL (US)

( * ) Notice: Subject to any disclaimer, the term of this patent is extended or adjusted under 35 U.S.C. 154(b) by 0 days.

(21) Appl. No.: 12/109,131

(22) Filed: Apr. 24, 2008

(65) Prior Publication Data

US 2009/0266126 A1 Oct. 29, 2009

(51) Int. Cl.
*B21D 51/26* (2006.01)

(52) U.S. Cl. ..... 72/94; 72/16.2; 72/17.3; 72/379.4; 72/405.03

(58) Field of Classification Search ..... 72/14.9, 72/15.3, 16.1, 16.2, 16.4, 17.3, 18.1, 18.2, 72/94, 379.4, 865.9; 73/865.9; 198/464.1, 198/478.1, 571, 572, 459.8, 575
See application file for complete search history.

(56) References Cited

U.S. PATENT DOCUMENTS

| | | | |
|---|---|---|---|
| 137,400 | A | 4/1873 | Ahrend |
| 548,888 | A | 10/1895 | Noteman |
| 593,755 | A | 11/1897 | Pond et al. |
| 1,459,584 | A | 6/1923 | Ericsson |
| 1,498,940 | A | 6/1924 | Wheeler |
| 1,621,301 | A | 3/1927 | Wright |
| 2,467,278 | A | 4/1949 | Thompson |
| 2,550,156 | A | 4/1951 | Lyon |
| 2,686,551 | A | 8/1954 | Laxo |
| 2,874,562 | A | 2/1959 | Cross |
| 2,928,454 | A | 3/1960 | Laxo |
| 2,940,502 | A | 6/1960 | La |
| 3,096,709 | A | 7/1963 | Eldred et al. |
| 3,344,685 | A | 10/1967 | Crouzet |
| 3,374,684 | A | 3/1968 | Greven |
| 3,406,648 | A | 10/1968 | David |
| 3,418,837 | A | 12/1968 | Vanderlaan et al. |
| 3,599,780 | A | 8/1971 | Sorbie |
| 3,621,530 | A | 11/1971 | Pflieger et al. |
| 3,635,069 | A | 1/1972 | Eickenhorst |

(Continued)

FOREIGN PATENT DOCUMENTS

| | | |
|---|---|---|
| CA | 2536841 | 2/2006 |

(Continued)

OTHER PUBLICATIONS

U.S. Appl. No. 11/643,935, filed Dec. 22, 2006, Shortridge et al.

*Primary Examiner*—Dana Ross
*Assistant Examiner*—Stephanie Jennings
(74) *Attorney, Agent, or Firm*—Woodcock Washburn LLP

(57) ABSTRACT

Systems and methods are employed for monitoring and controlling a can necking process in a multi-stage can necking machine. Sensors are employed that communicate with local controllers. A local controller is used at each stage of the multi-stage can necking machine. The local controllers are used to perform fast processing of information from the sensors located in the stage associated with the local controller. A main controller is then used to determine drop rates. Predefined threshold rates may be used to compare with calculated drop rates. A multi-stage can necking machine may be controlled in part based on drop rates crossing threshold rates.

18 Claims, 10 Drawing Sheets

U.S. PATENT DOCUMENTS

| | | | | |
|---|---|---|---|---|
| 3,659,443 | A | 5/1972 | Ball | |
| 3,687,098 | A | 8/1972 | Maytag | |
| 3,797,429 | A | 3/1974 | Wolfe | |
| 3,983,729 | A | 10/1976 | Traczyk et al. | |
| 4,030,432 | A | 6/1977 | Miller et al. | |
| 4,164,997 | A | 8/1979 | Mueller | |
| 4,341,103 | A | 7/1982 | Escallon et al. | |
| 4,513,595 | A | 4/1985 | Cvacho | |
| 4,519,232 | A | 5/1985 | Traczyk et al. | |
| 4,576,024 | A | 3/1986 | Weber | |
| 4,590,788 | A | 5/1986 | Wallis | |
| 4,593,369 | A * | 6/1986 | Thompson | 702/82 |
| 4,671,093 | A | 6/1987 | Dominico et al. | |
| 4,693,108 | A | 9/1987 | Traczyk et al. | |
| 4,817,409 | A | 4/1989 | Bauermeister | |
| 4,838,064 | A | 6/1989 | Paess | |
| 4,892,184 | A | 1/1990 | Vander Griendt et al. | |
| 5,209,101 | A | 5/1993 | Finzer | |
| 5,226,303 | A | 7/1993 | Dieden et al. | |
| 5,235,839 | A | 8/1993 | Lee, Jr. et al. | |
| 5,245,848 | A | 9/1993 | Lee, Jr. et al. | |
| 5,282,375 | A | 2/1994 | Lee, Jr. et al. | |
| 5,349,836 | A | 9/1994 | Lee, Jr. | |
| 5,353,619 | A | 10/1994 | Chu et al. | |
| 5,467,628 | A | 11/1995 | Bowlin et al. | |
| 5,540,320 | A | 7/1996 | Sarto et al. | |
| 5,553,826 | A | 9/1996 | Schultz | |
| 5,611,231 | A | 3/1997 | Marritt et al. | |
| 5,634,364 | A | 6/1997 | Gardner et al. | |
| 5,676,006 | A | 10/1997 | Marshall | |
| 5,713,235 | A | 2/1998 | Diekhoff | |
| 5,755,130 | A | 5/1998 | Tung et al. | |
| 5,782,308 | A | 7/1998 | Latten et al. | |
| 5,906,120 | A | 5/1999 | Thacker et al. | |
| 6,032,502 | A | 3/2000 | Halasz et al. | |
| 6,055,836 | A | 5/2000 | Waterworth et al. | |
| 6,085,563 | A | 7/2000 | Heiberger et al. | |
| 6,167,743 | B1 | 1/2001 | Marritt et al. | |
| 6,176,006 | B1 | 1/2001 | Milliman | |
| 6,178,797 | B1 | 1/2001 | Marshall et al. | |
| 6,199,420 | B1 | 3/2001 | Bartosch | |
| 6,240,760 | B1 | 6/2001 | Heiberger et al. | |
| 6,571,986 | B1 | 6/2003 | Simmons | |
| 6,644,083 | B2 | 11/2003 | Pakker | |
| 6,658,913 | B1 | 12/2003 | Zanzerl et al. | |
| 6,661,020 | B2 | 12/2003 | Schill et al. | |
| 6,672,122 | B2 | 1/2004 | Mustread et al. | |
| 6,698,265 | B1 | 3/2004 | Thomas | |
| 6,752,000 | B2 | 6/2004 | Reynolds et al. | |
| 6,779,651 | B1 | 8/2004 | Linglet et al. | |
| 7,028,857 | B2 | 4/2006 | Peronek | |
| 7,069,765 | B2 | 7/2006 | Grove et al. | |
| 7,100,417 | B2 | 9/2006 | Yamanaka et al. | |
| 2002/0029599 | A1 * | 3/2002 | Heiberger et al. | 72/94 |
| 2004/0069027 | A1 | 4/2004 | Fukushima | |
| 2005/0193796 | A1 | 9/2005 | Heiberger et al. | |
| 2006/0101884 | A1 | 5/2006 | Schill et al. | |
| 2006/0101885 | A1 | 5/2006 | Schill et al. | |
| 2006/0101889 | A1 | 5/2006 | Schill et al. | |
| 2006/0104745 | A1 | 5/2006 | Schill et al. | |
| 2007/0227218 | A1 | 10/2007 | Shortridge | |
| 2007/0227320 | A1 | 10/2007 | Marshall | |
| 2007/0227859 | A1 | 10/2007 | Marshall et al. | |
| 2007/0249424 | A1 | 10/2007 | Marshall et al. | |
| 2007/0251803 | A1 | 11/2007 | Schill et al. | |
| 2007/0283544 | A1 | 12/2007 | Schill et al. | |
| 2007/0283665 | A1 | 12/2007 | Schill et al. | |

FOREIGN PATENT DOCUMENTS

| | | | |
|---|---|---|---|
| DE | 19 39 623 | A1 | 2/1970 |
| DE | 101 56 085 | A1 | 5/2003 |
| EP | 0 885 076 | | 7/2002 |
| FR | 2 881 123 | A1 | 7/2006 |
| GB | 189707306 | | 3/1898 |
| GB | 2173437 | A | 10/1986 |
| JP | 2002 102968 | | 4/2002 |
| JP | 2003-237752 | | 8/2003 |
| JP | 2003 251424 | | 9/2003 |
| JP | 2003-252321 | | 9/2003 |
| JP | 2003320432 | | 11/2003 |
| JP | 2004-002557 | | 1/2004 |
| JP | 2004-130386 | | 4/2004 |
| JP | 2004160468 | | 6/2004 |
| JP | 2004-217305 | | 8/2004 |
| JP | 2005-022663 | | 1/2005 |
| JP | 2006-176140 | | 7/2006 |
| JP | 2006-176183 | | 7/2006 |
| WO | WO 94/12412 | | 6/1994 |
| WO | WO 97/37786 | A1 | 10/1997 |
| WO | WO 97/49509 | | 12/1997 |
| WO | WO 00/23212 | A | 4/2000 |
| WO | WO 2006/055185 | A | 5/2006 |
| WO | WO 2006/067901 | | 6/2006 |

* cited by examiner

SYSTEMS AND METHODS FOR MONITORING AND CONTROLLING A CAN NECKING PROCESS

CROSS REFERENCE TO RELATED APPLICATIONS

This application is related by subject matter to the inventions disclosed in the following commonly assigned applications: U.S. patent application Ser. No. 12/109,031 filed on Apr. 24, 2008 and entitled "Apparatus For Rotating A Container Body", U.S. patent application Ser. No. 12/108,950 filed on Apr. 24, 2008 and entitled "Adjustable Transfer Assembly For Container Manufacturing Process", U.S. patent application Ser. No. 12/109,058 filed on Apr. 24, 2008 and entitled "Distributed Drives for A Multi-Stage Can Necking Machine", U.S. patent application Ser. No. 12/108,926 filed on Apr. 24, 2008 and entitled "Container Manufacturing Process Having Front-End Winder Assembly", and U.S. patent application Ser. No. 12/109,176 filed on Apr. 24, 2008 and entitled "High Speed Necking Configuration." The disclosure of each application is incorporated by reference herein in its entirety.

BACKGROUND

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been the conventional practice to reduce the diameter at the top of the can to reduce the weight of the can end in a process referred to as necking. Cans may be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of $2\frac{11}{16}^{th}$ inches to $2\frac{6}{16}^{th}$ inches (that is, from a 211 to a 206 size) often requires multiple stages, often 14.

Each of the necking stages typically includes a main turret shaft that carries a starwheel for holding the can bodies, a die assembly that includes the tooling for reducing the diameter of the open end of the can, and a pusher ram to push the can into the die tooling. Each necking stage also typically includes a transfer starwheel to transfer cans between turret starwheels. Often, a waxer station is positioned at the inlet of the necking stages, and a bottom reforming station, a flanging station and a light testing station are positioned at the outlet of the necking stages.

The collective stages of the can necking process, including the various components described above may collectively be referred to as a can necking machine or a multi-stage can necking machine. In a properly operated can line, cans fill the pockets of the necking machine in an unbroken, serpentine line. In part because of the high speed operation of can necking machines, however, errors may occur during the can necking process. One type of error may be evidenced by losing cans from a can necking machine (that is, a pocket that should have a can does not have a can). A can lost from the can necking machine may also be referred to as a "dropped" can, and encompasses a can that enters the can necking machine but is not properly retained and a pocket that lacks a can because of a can feed error (that is, the line of cans is broken because of a break in the continuous can feed).

Identifying can drop rates may assist in troubleshooting a can necking machine. However, increasing the number of stages or increasing the speed of the can necking process may make timely identification of can drop rates difficult or limit the speed at which a can necking machine may be operated.

SUMMARY

Systems and methods are provided to monitor and control a can necking process in a multi-stage can necking machine.

Systems and methods are used to track how often a multi-stage can necking machine drops a can. A drop rate may track how many cans are dropped in a given period of time. Drop rates may be calculated based on information provided by sensors used to sense whether a can is present in a pocket being sensed. Threshold rates may be predefined drop rate values. Threshold rates may be set based on numerous factors, such as efficiency, safety and machine hazards. Threshold values may be employed to initiate control actions on a multi-stage can necking machine. For example, when a drop rate crosses a threshold rate, a predetermined control action may be taken, including slowing down, stopping or speeding-up a multi-stage can necking machine.

Systems and methods are used to timely determine when threshold rates are met or crossed. A local controller may be provided for every stage of a multi-stage can necking machine. Local controllers allow for fast processing from can sensors. In addition, one or more main controllers may perform calculation and control functions. By splitting the monitoring and calculation/control functions, threshold rates that are met or crossed may be timely identified.

DETAILED DESCRIPTION OF ILLUSTRATIVE EMBODIMENTS

Figure 1:
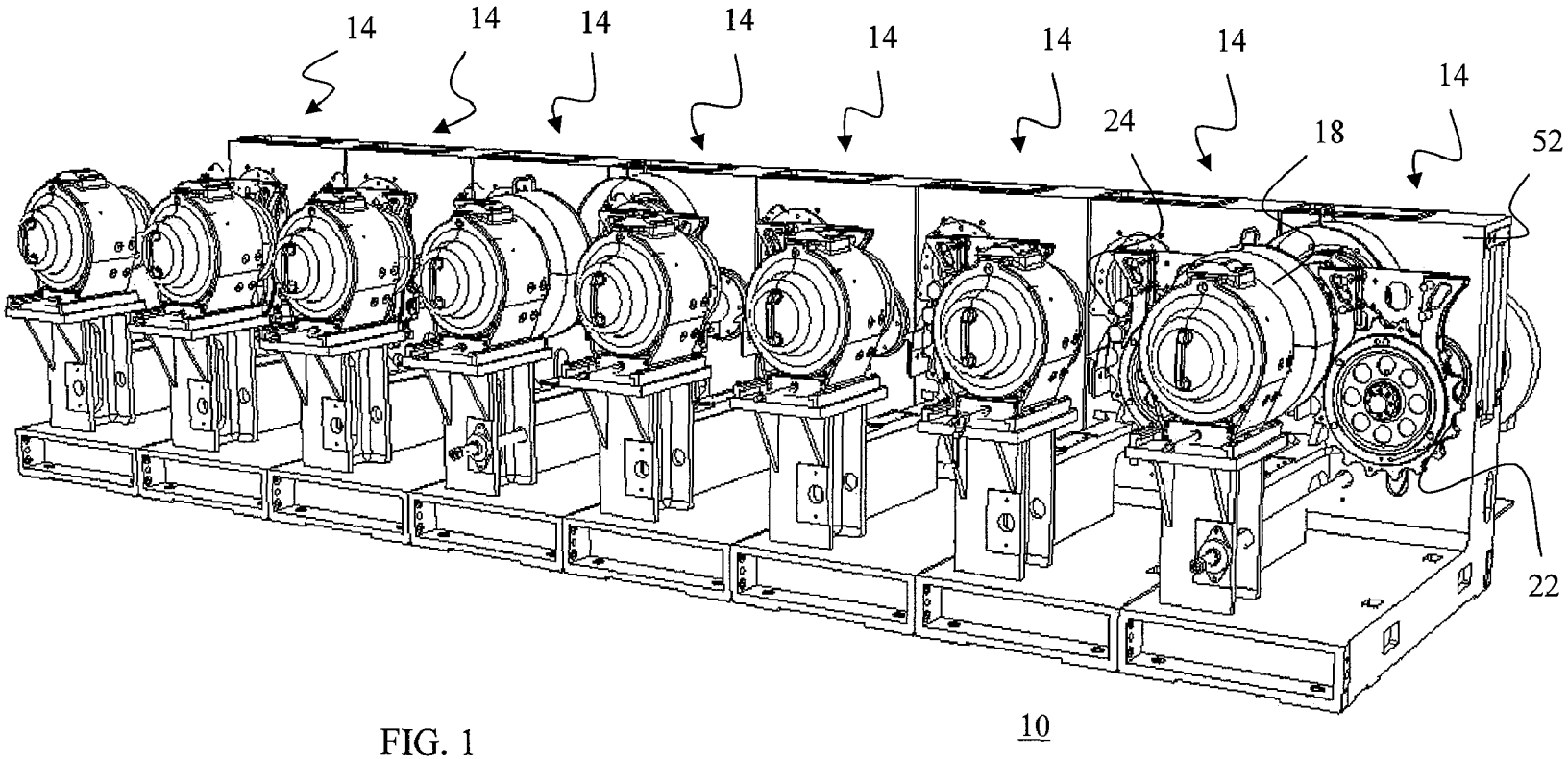
FIG. 1 is a perspective view depicting a multi-stage can necking machine.

As shown in FIG. 1, a multi-stage can necking machine 10 may include several necking stages 14. Each necking stage 14 includes a necking station 18 and a transfer starwheel 22.

Each one of the necking stations 18 is adapted to incrementally reduce the diameter of an open end of a can body, and the transfer starwheels 22 are adapted to transfer the can body between adjacent necking stations 18, and optionally at the inlet and outlet of necking machine 10. Conventional multi-stage can necking machines, in general, include an input station and a waxer station at an inlet of the necking stages, and optionally include a bottom reforming station, a flanging station, and a light testing station positioned at an outlet of the necking stages. Accordingly, multi-stage can necking machine 10, may include in addition to necking stages 14, other operation stages such as an input station, a bottom reforming station, a flanging station, and a light testing station as in conventional multi-stage can necking machines (not shown). The term "operation stage" or "operation station" and its derivative is used herein to encompass the necking station 14, bottom reforming station, a flanging station, and a light testing station, and the like. Preferably, multi-stage can necking machine 10 is operative to neck and move at least 2800 cans per minute, more preferably at least 3200 cans per minute, and even more preferably at least 3400 cans per minute.

Figure 2:
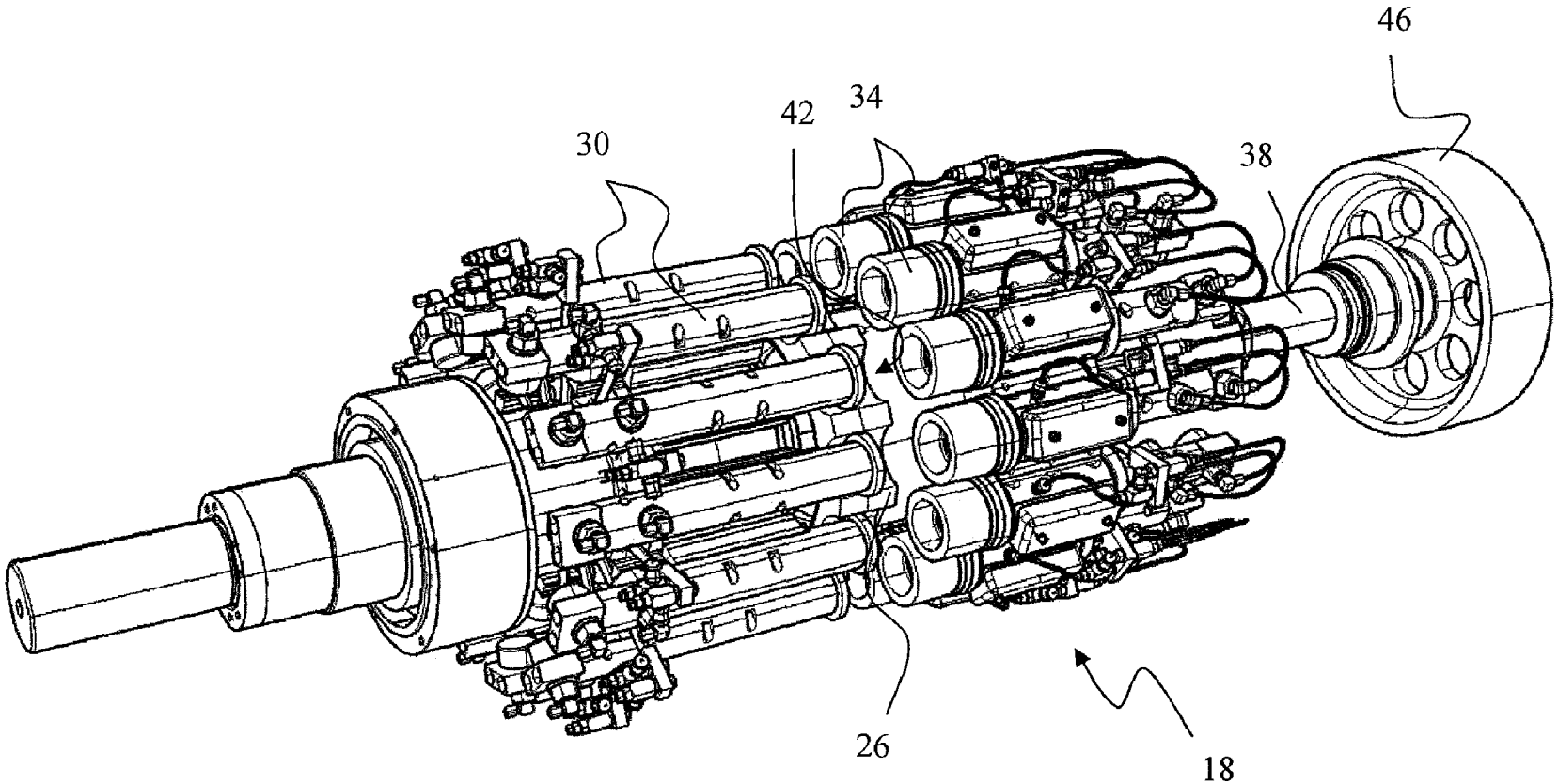
FIG. 2 is a perspective view depicting a necking station and gear mounted on a main turret shaft of the multi-stage necking machine shown in FIG. 1, with surrounding and supporting parts removed for clarity.

FIG. 2 is a detailed view depicting operative parts of one of the necking stations 18. As shown, each necking station 18 includes a main turret 26, a set of pusher rams 30, and a set of dies 34. The main turret 26, the pusher rams 30, and the dies 34 are each mounted on a main turret shaft 38. As shown, the main turret 26 has a plurality of pockets 42 formed therein. Each pocket 42 has a pusher ram 30 on one side of the pocket 42 and a corresponding die 34 on the other side of the pocket 42. In operation, each pocket 42 is adapted to receive a can body and securely holds the can body in place by mechanical means, such as by the action pusher ram and the punch and die assembly, and compressed air, as is understood in the art. During the necking operation, the open end of the can body is brought into contact with the die 34 by the pusher ram 30 as the pocket 42 on main turret 26 carries the can body through an arc along a top portion of the necking station 18.

Die 34, in transverse cross section, is typically designed to have a lower cylindrical surface with a dimension capable of receiving the can body, a curved transition zone, and a reduced diameter upper cylindrical surface above the transition zone. During the necking operation, the can body is moved up into die 34 such that the open end of the can body is placed into touching contact with the transition zone of die 34. As the can body is moved further upward into die 34, the upper region of the can body is forced past the transition zone into a snug position between the inner reduced diameter surface of die 34 and a form control member or sleeve located at the lower portion of pusher ram 30. The diameter of the upper region of the can is thereby given a reduced dimension by die 34. A curvature is formed in the can wall corresponding to the surface configuration of the transition zone of die 34. The can is then ejected out of die 34 and transferred to an adjacent transfer starwheel. U.S. Pat. No. 6,094,961, which is incorporated herein by reference, discloses an example necking die used in can necking operations.

As best shown in FIG. 2, a main turret gear 46 (shown schematically in FIG. 2 without teeth) is mounted proximate to an end of shaft 38. The gear 46 may be made of suitable material, and preferably is steel.

Figure 3:
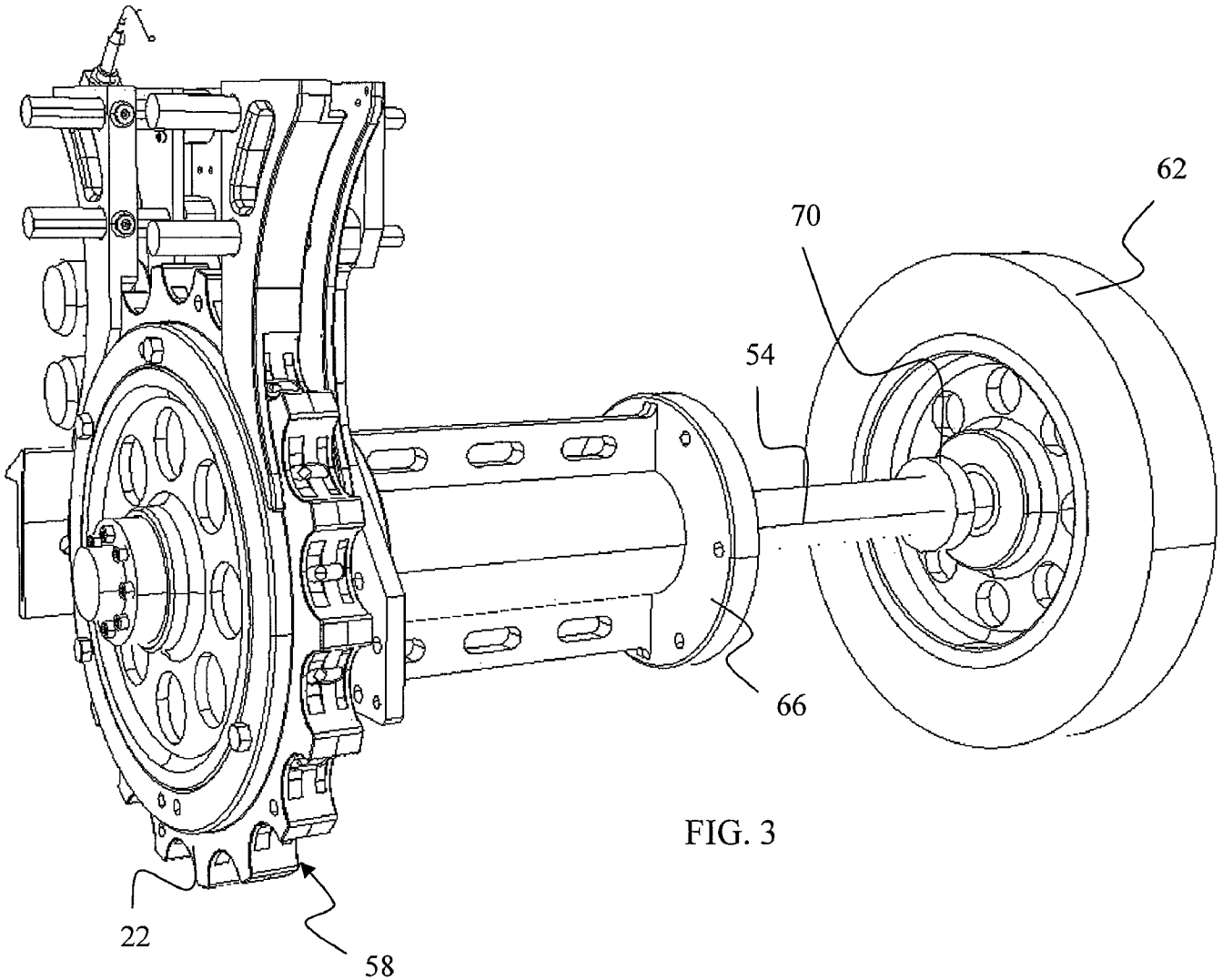
FIG. 3 is a perspective view depicting a transfer starwheel and gear mounted on a starwheel shaft of the multi-stage necking machine shown in FIG. 1, with surrounding and supporting parts removed for clarity.

As shown in FIG. 3, each starwheel 22 may be mounted on a shaft 54, and may include several pockets 58 formed therein. The starwheels 22 may have any amount of pockets 58. For example each starwheel 22 may include twelve pockets 58 or even eighteen pockets 58, depending on the particular application and goals of the machine design. Each pocket 58 is adapted to receive a can body and retains the can body using a vacuum force. The vacuum force should be strong enough to retain the can body as the starwheel 22 carries the can body through an arc along a bottom of the starwheel 22.

As shown, a gear 62 (shown schematically in FIG. 3 without teeth) is mounted proximate to an end of the shaft 54. Gear 62 may be made of steel but preferably is made of a composite material. For example, each gear 62 may be made of any conventional material, such as a reinforced plastic, such as Nylon 12.

As also shown in FIG. 3, a horizontal structural support 66 supports transfer shaft 54. Support 66 includes a flange at the back end (that is, to the right of FIG. 3) for bolting to an upright support of the base of machine 10 and includes a bearing (not shown in FIG. 3) near the front end inboard of the transfer starwheel 22. Accordingly, transfer starwheel shaft 54 is supported by a back end bearing 70 that preferably is bolted to upright support 52 and a front end bearing that is supported by horizontal support 66, which itself is cantilevered from upright support 52. Preferably the base and upright support 52 is a unitary structure for each operation stage.

Figure 4:
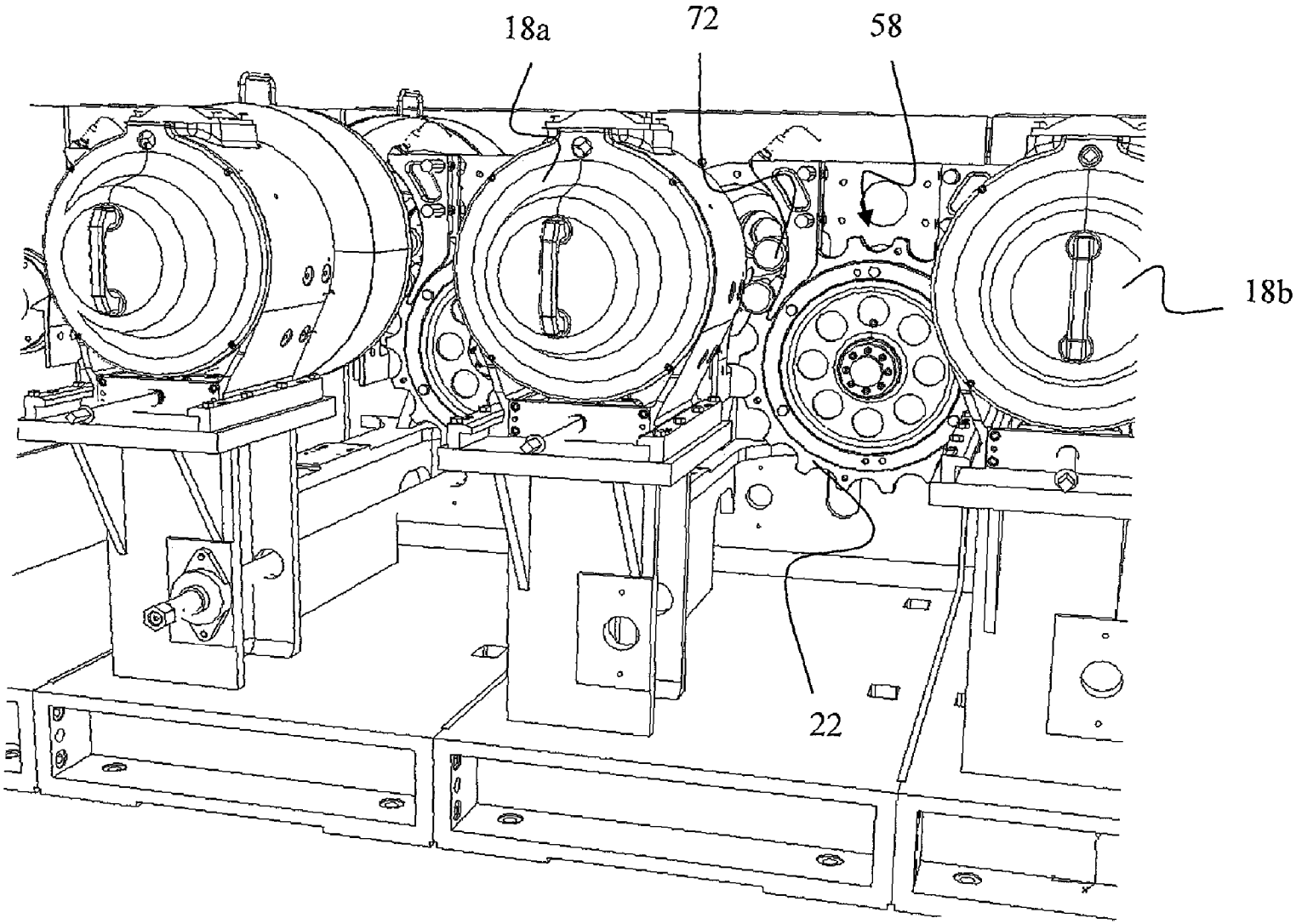
FIG. 4 is a partial expanded view depicting a section of the multi-stage can necking machine shown in FIG. 1.

FIG. 4 illustrates a can body 72 exiting a necking stage and about to transfer to a transfer starwheel 22. After the diameter of the end of a can body 72 has been reduced by the first necking station 18*a* shown in the middle of FIG. 4, main turret 26 of the necking station 18*a* deposits the can body into a pocket 58 of the transfer starwheel 22. The pocket 58 then retains the can body 72 using a vacuum force that is induced into pocket 58 from the vacuum system described in co-pending application Ser. No. 12/109,058, which is incorporated herein by reference in its entirety, carries the can body 72 through an arc over the bottommost portion of starwheel 22, and deposits the can body 72 into one of the pockets 42 of the main turret 26 of an adjacent necking station 18*b*. The necking station 18*b* further reduces the diameter of the end of the can body 72 in a manner substantially identical to that noted above.

Machine 10 may be configured with any number of necking stations 18, depending on the original and final neck diameters, material and thickness of can 72, and like parameters, as understood by persons familiar with can necking technology. For example, multi-stage can necking machine 10 illustrated in the figures includes eight stages 14, and each stage incrementally reduces the diameter of the open end of the can body 72 as described above.

Figure 5:
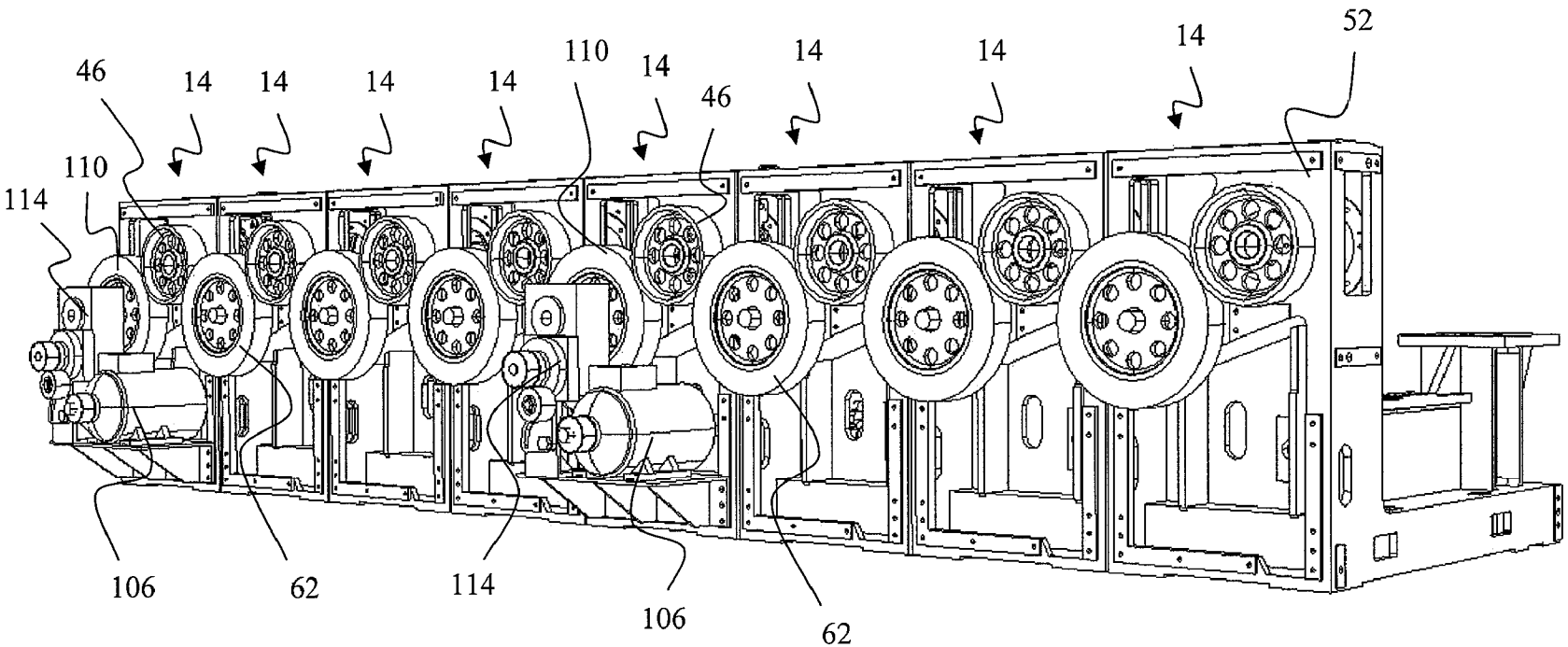
FIG. 5 is a perspective view depicting a back side of a multi-stage can necking machine having distributed drives.

As shown in FIG. 5, when the shafts 38 and 54 are supported near their rear ends by upright support 52, and the ends of the shafts 38 and 54 preferably are cantilevered such that the gears 46 and 62 are exterior to the supports 52. A cover (not shown) for preventing accidental personnel contact with gears 46 and 62, may be located over gears 46 and 62. As shown, the gears 46 and 62 are in mesh communication to form a continuous gear train. The gears 46 and 62 preferably are positioned relative to each other to define a zig-zag or saw tooth configuration. That is, the main gears 46 are engaged with the transfer starwheel gears 62 such that lines through the main gear 46 center and the centers of opposing transfer starwheel gears 62 form an included angle of less than 170 degrees, preferably approximately 120 degrees, thereby increasing the angular range available for necking the can body. In this regard, because the transfer starwheels 22 have centerlines below the centerlines of main turrets 26, the operative portion of the main turret 26 (that is, the arc through which the can passes during which the necking or other operation can be performed) is greater than 180 degrees on the main turret 26, which for a given rotational speed provides the can with greater time in the operative zone. Accordingly the operative zone has an angle (defined by the orientation of the centers of shafts 38 and 54) greater than about 225 degrees, and even more preferably, the angle is greater than 240 degrees. The embodiment shown in the figures has an operative zone having an angle of 240 degrees. In general, the greater the angle that defines the operative zone, the greater the angular range available for necking the can body.

In this regard, for a given rotational speed, the longer residence time of a can in the operative zone enables a longer stroke length for a given longitudinal speed of the pusher ram. For example, with the above identified configuration, the pusher ram 30 may have a stroke length relative to the die 34 of at least 1.5 inches. Preferably, the pusher ram 30 will have a stroke length relative to the die 34 of at least 1.625 inches and even more preferably the stroke length is at least 1.75 inches. For the embodiment shown in the figures, the stroke length is approximately 1.75 inches.

Figure 6A:
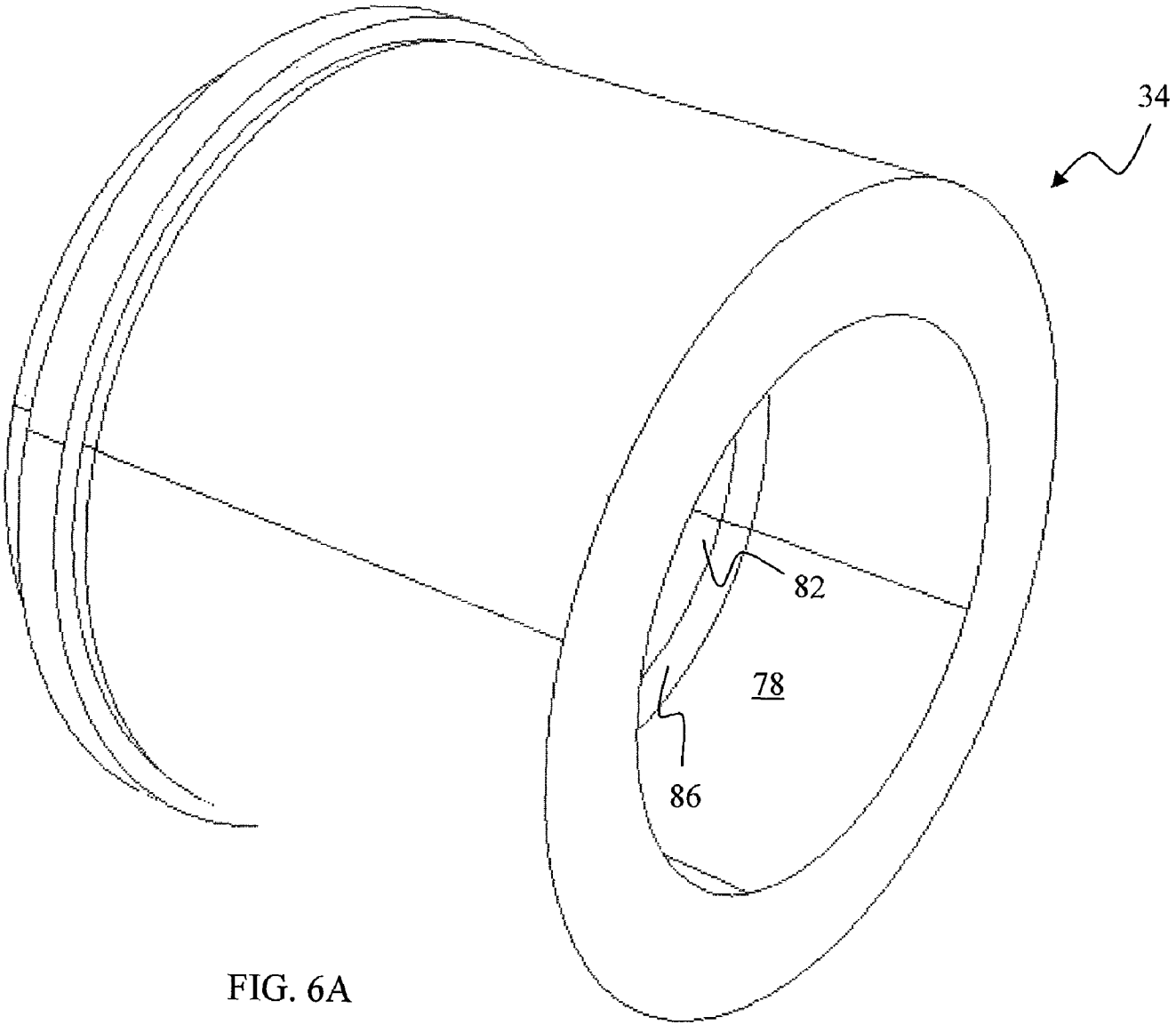
FIG. 6A is a perspective view depicting a forming die.
Figure 6B:
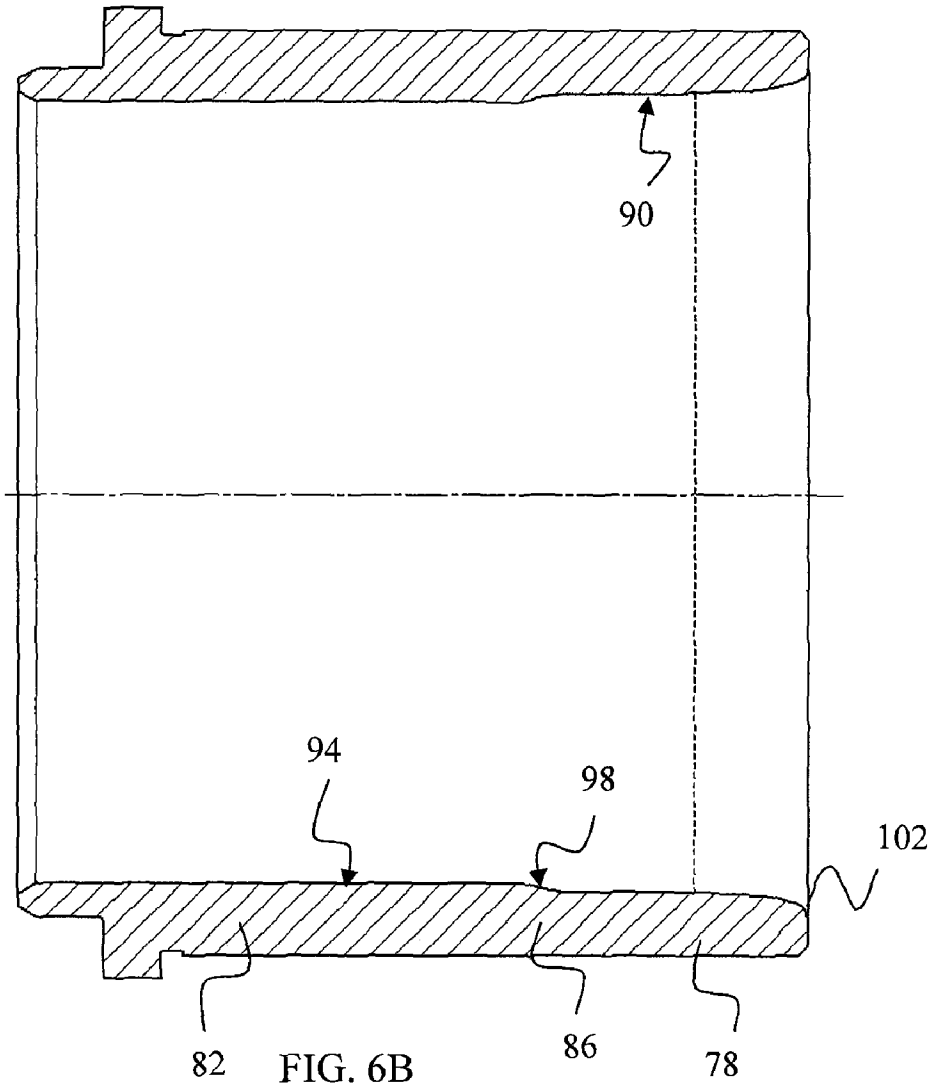
FIG. 6B is a cross-sectional view of the forming die depicted in FIG. 6A.

The angular range available for necking of greater than 180 degrees, enables the die used to reduce the diameter of the end of the can body to be designed to improve the concentricity of the can end. As shown in FIGS. 6A and 6B, the die 34, includes a throat portion 78, a body portion 82 and a transition portion 86. As shown, the throat portion 78 has an inner surface 90 that defines a cylinder having a first diameter, the body portion 82 has an inner surface 94 that defines a cylinder having a second diameter, and the transition portion 86 has an inner surface 98 that extends smoothly from the inner surface 90 of the throat portion 78 to the inner surface 94 of the body portion 82. The first diameter should be large enough to receive the can body and the second diameter should be sized so that the diameter of the end of the can body can be reduced to a desired diameter.

These are stroke lengths. To help improve the concentricity of the can end the throat portion preferably has a length of at least 0.125 inches, more preferably a length of at least 0.25 inches and even more preferably a length of at least 0.375 inches. Furthermore, an inlet 102 of the throat portion 78 may be rounded.

During operation of conventional stroke machines, the first part of the can that touches the die is the neck. Any error in the neck portion often becomes worse, throughout the necking stages. In the long stroke machine, when the can goes into the die, it first locates itself in the die before it touches the transition portion. Therefore, by having a longer throat portion 78, the die 34 is able to center the can body prior to necking. Additionally, by having a longer throat portion 78, the die 34 is able to seal the compressed air sooner. Until the can is sealed, the compresses air blows into the air, which can be costly.

Referring back to FIG. 5, the multi-stage can necking machine 10 may include several motors 106 to drive the gears 46 and 62 of each necking stage 14. As shown, there preferably is one motor 106 per every four necking stages 14. Each motor 106 is coupled to and drives a first gear 110 by way of a gear box 114. The motor driven gears 110 then drive the remaining gears of the gear train. By using multiple motors 106, the torque required to drive the entire gear train can be distributed throughout the gears, as opposed to prior art necking machines that use a single motor to drive the entire gear train. In the prior art gear train that is driven by a single gear, the gear teeth must be sized according to the maximum stress. Because the gears closest to the prior art drive gearbox must transmit torque to the entire gear train (or where the single drive is located near the center on the stages, must transmit torque to about half the gear train), the maximum load on prior art gear teeth is higher than the maximum tooth load of the distributed gearboxes according to the present invention. The importance in this difference in tooth loads is amplified upon considering that the maximum loads often occur in emergency stop situations. A benefit of the lower load or torque transmission of gears 46 and 62 compared with that of the prior art is that the gears can be more readily and economically formed of a reinforced thermoplastic or composite, as described above. Lubrication of the synthetic gears can be achieved with heavy grease or like synthetic viscous lubricant, as will be understood by persons familiar with lubrication of gears of necking or other machines, even when every other gear is steel as in the presently illustrated embodiment. Accordingly, the gears are not required to be enclosed in an oil-tight chamber, but rather merely require a minimal protection against accidental personnel contact Each motor 106 is driven by a separate inverter which supplies the motors 106 with current. To achieve a desired motor speed, the frequency of the inverter output is altered, typically between zero to 50 (or 60 hertz). For example, if the motors 106 are to be driven at half speed (that is, half the rotational speed corresponding to half the maximum or rated throughput) they would be supplied with 25 Hz (or 30 Hz).

Figure 7:
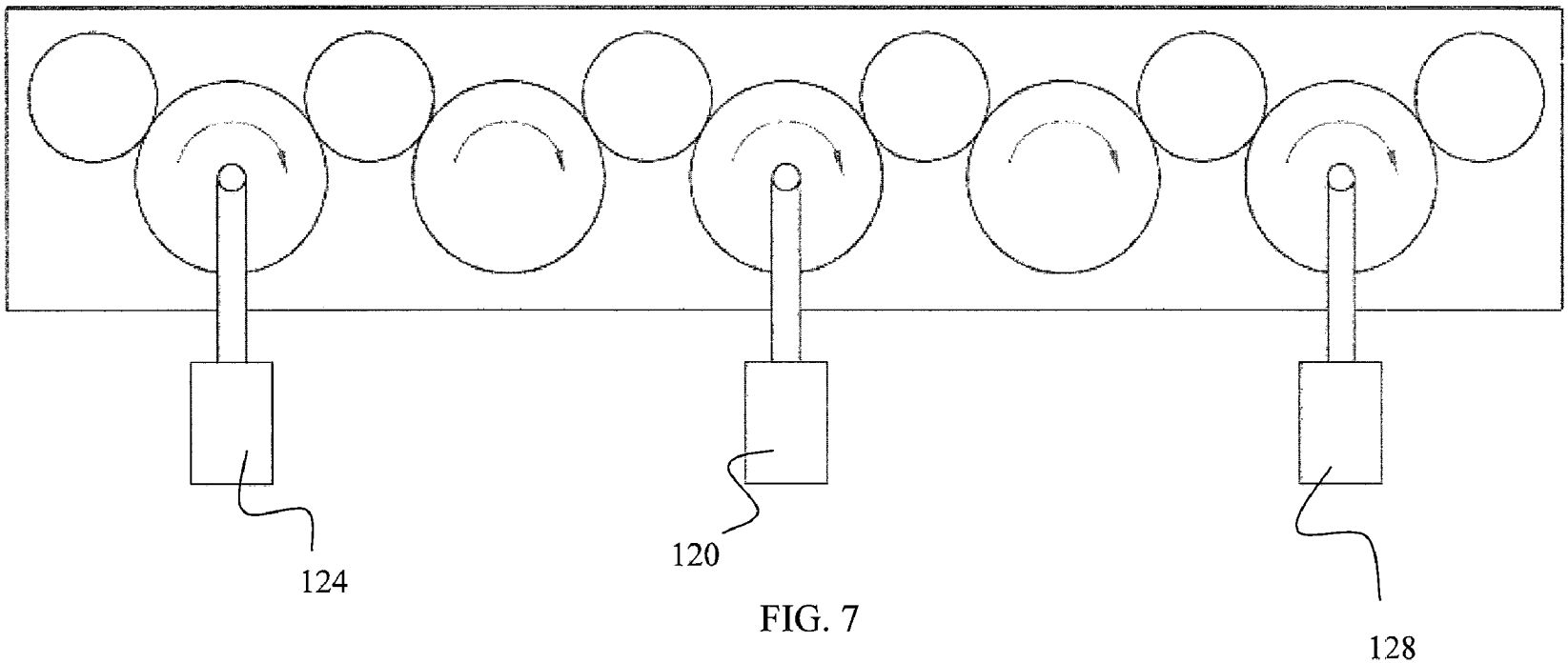
FIG. 7 is a schematic illustrating a machine having distributed drives.

In the case of the distributed drive configuration shown herein, each motor inverter is set at a different frequency. Referring to FIG. 7 for example, a second motor 120 may have a frequency that is approximately 0.02 Hz greater than the frequency of a first motor 124, and a third motor 128 may have a frequency that is approximately 0.02 Hz greater than the frequency of the second motor 120. It should be understood that the increment of 0.02 Hz may be variable, however, it will be by a small percentage (in this case less than 1%).

Figure 8:
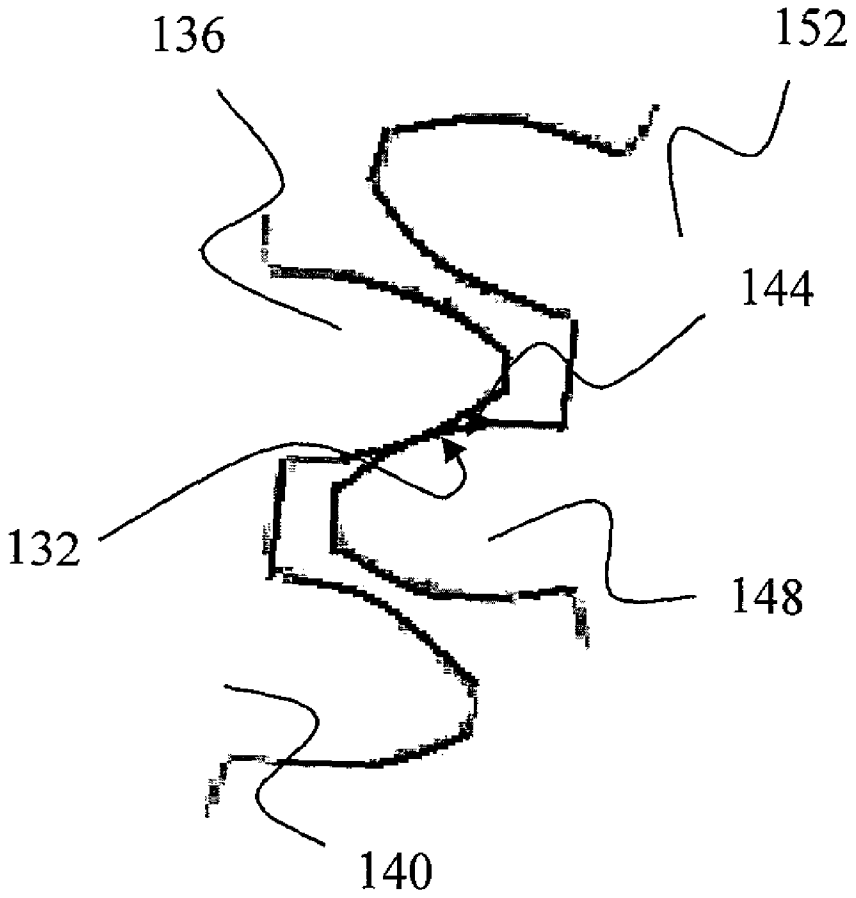
FIG. 8 is a partial expanded view depicting gear teeth from adjacent gears engaging each other.

The downstream motors preferably are preferably controlled to operate at a slightly higher speed to maintain contact between the driving gear teeth and the driven gear teeth throughout the gear train. Even a small freewheeling effect in which a driven gear loses contact with its driving gear could introduce a variation in rotational speed in the gear or misalignment as the gear during operation would not be in its designed position during its rotation. Because the operating turrets are attached to the gear train, variations in rotational speed could produce misalignment as a can 72 is passed between starwheel and main turret pockets and variability in the necking process. The actual result of controlling the downstream gears to operate a slightly higher speed is that the motors 120, 124, and 128 all run at the same speed, with motors 120 and 128 "slipping," which should not have any detrimental effect on the life of the motors. Essentially, motors 120 and 128 are applying more torque, which causes the gear train to be "pulled along" from the direction of motor 128. Such an arrangement eliminates variation in backlash in the gears, as they are always contacting on the same side of the tooth, as shown in FIG. 8. As shown in FIG. 8, a contact surface 132 of a gear tooth 136 of a first gear 140 may contact a contact surface 144 of a gear tooth 148 of a second gear 152. This is also true when the machine starts to slow down, as the speed reduction is applied in the same way (with motor 128 still being supplied with a higher frequency). Thus "chattering" between the gears when the machine speed changes may be avoided.

In the case of a machine using one motor, reductions in speed may cause the gears to drive on the opposite side of the teeth. It is possible that this may create small changes in the relationship between the timing of the pockets passing cans from one turret to the next, and if this happens, the can bodies may be dented.

Errors may occur during the can necking process, including the multi-stage can necking machine dropping a can (e.g., when a pocket that should have a can body does not have a can body there has been a drop). The term "drop" as used refers to an interruption in the otherwise unbroken line of can bodies though necking machine 10 whether can body properly enters necking machine 10 and is inadvertently (or intentionally) ejected or the feed of can bodies is interrupted. Ways to track drops include determining a number of dropped cans or determining drop rates. Determining a number of dropped cans focuses on an overall number of drops. Drop rates may track how many cans are dropped in a given time period or per unit time. For illustration purposes, the following discussion focuses mainly on drop rates and associated quantities, however, the claimed embodiments may also be implemented by using the number of drops.

The efficiency of a can necking process may be increased by identifying can drop rates from a multi-stage can necking machine, as well as the location or locations from which cans were dropped. Timely identification of drops may assist in preventing waste. For example, it may be determined that if a certain drop rate is crossed, that the cost of stopping the multi-stage can necking machine may be overcome by the benefits gained by troubleshooting and repairing the error.

There are also other useful reasons to identify drop rates, such as safety and damage control. For example, dropped cans may make a working environment unsafe as cans may pile up in and around a multi-stage can necking machine. Cans may also get caught in equipment, which may be hazardous to the multi-stage can necking machine and dangerous to clear. Cans caught in equipment may also be launched or shredded, which may also be hazardous.

In order to use drop rates to control or analyze the operation of a multi-stage can necking machine, threshold rates may be set. A threshold rate may be defined as a predefined number of dropped cans in a given time period. A threshold rate may be used as a control mechanism, that is, to initiate a control action on a multi-stage can necking machine upon reaching or crossing the threshold value. For example, when a threshold rate is met or crossed, a control action may be taken. For simplicity, threshold rates will be discussed as initiating control actions when crossed, but may also include the situation when a threshold is met. Control actions that may be taken when a threshold rate is crossed include implementing enhanced quality assurance procedures as well as slowing, stopping, or speeding-up a multi-stage can necking machine.

Any of the above factors, or any additional factors, may be used to set threshold rates and control actions to be taken in association with crossing a threshold rate. For example, a threshold of ten drops per minute may be set as a threshold rate to slow down a multi-stage can necking machine. As a result, when the drop rate crosses ten drops per minute the speed of the multi-stage can necking machine may be decreased. Similarly, a threshold of twenty cans per minute may be set as a threshold rate to stop a multi-stage can necking machine. As a result, when the drop rate crosses twenty drops per minute, the multi-stage can necking machine may be stopped. Another example is a threshold rate of two cans per minute to increase the speed of the multi-stage can necking machine. As a result, if the drop rate is less than two cans per minute the speed of the multi-stage can necking machine may be increased.

Figure 9:
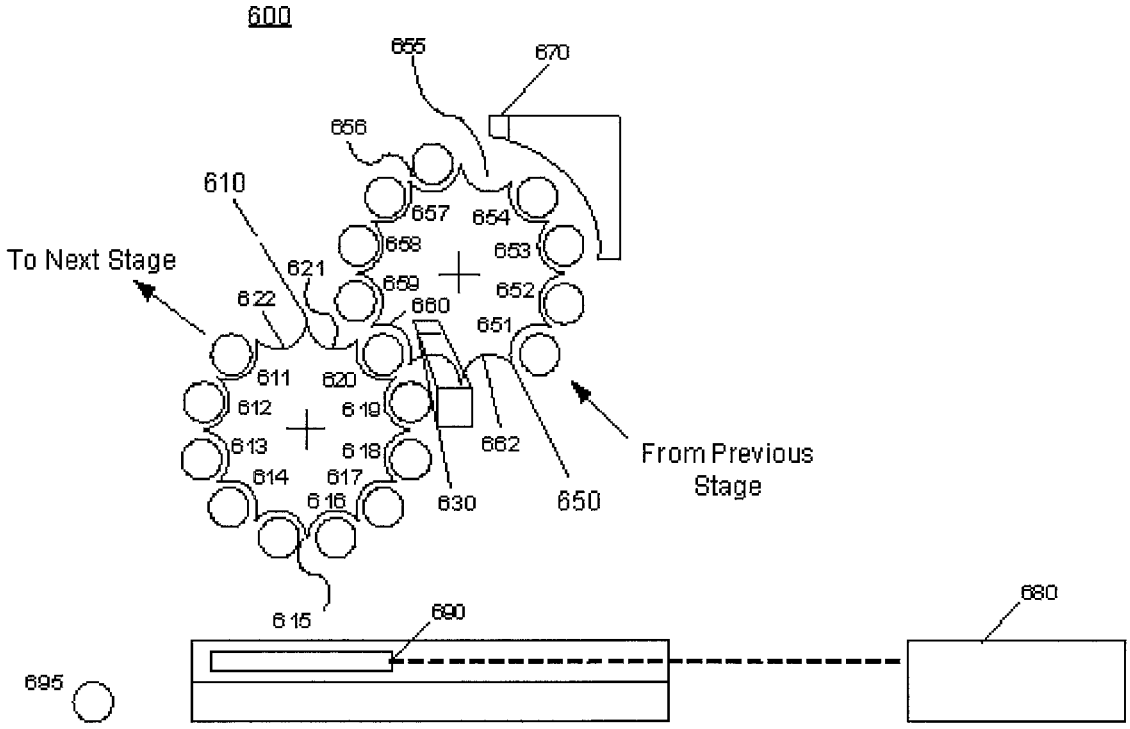
FIG. 9 illustrates parts of an exemplary stage in a multi-stage can necking machine.

FIG. 9 illustrates parts of an exemplary stage 600 of a multi-stage can necking machine as well as a main controller 680. Stage 600 includes a starwheel 610, starwheel pockets 611-622, a starwheel sensor 630, a turret 650, turret pockets 651-662, a turret sensor 670 and a local controller 690. Also illustrated in FIG. 9 is a dropped can 695. FIG. 9 illustrates starwheel sensor 630 associated with starwheel 610 and turret sensor 670 associated with turret 650. Although not shown, other components of a multi-stage can necking machine may also be monitored and controlled, including an input station, a waxer station, a reforming station, a flanging station and a light testing station.

Sensors 630 and 670 sense whether a can is present in the pocket adjacent to the sensor. Sensors 630 and 670 may be proximity sensors or any type of sensor that may detect whether a can is present in a pocket. FIG. 9 illustrates the use of a single sensor for multiple pockets, that is, starwheel sensor 630 is associated with starwheel pockets 611-622 on starwheel 610 and turret sensor 670 is associated with turret pockets 651-662 on turret 650. In this way, every pocket may be monitored when a starwheel 610 or turret 650 makes a full rotation. However, the sensor arrangement of FIG. 9 is not meant to be limiting. For example, any number of sensors may be used. Sensors may be placed at every pocket and sensors may be placed on a turret or wheel. For example, by placing a sensor at every pocket, every pocket may be continuously monitored.

In a preferred embodiment there is a local controller 690 associated with every stage of the multi-stage can necking machine. However, the embodiments anticipate other configurations that provide local controllers that handle more than one stage. Sensors 630 and 670 may communicate with local controller 690. Local controller 690 may be, for example, Allen Bradley Micrologix Programmable Logic Controllers (PLC), such as Model Number 1763-L16BBB. Sensors 630 and 670 may indicate to the local controller 690 when a can is present. In addition, sensors 630 and 670 may indicate to local controller 690 when a can is not present in the pocket being sensed. For example, as shown in FIG. 9, dropped can 695 has been dropped from pocket 655. As a result, sensor 670 will indicate that a can is not present in pocket 655.

A resolver (not shown in the figures), which is preferably located on the infeed turret, outputs a timing signal that can synchronize local controller 690 with sensors 630 and 670 so that information (especially the presence of lack of a can in a pocket) is sensed at the right time. Accuracy and speed may be improved by using the timing signal to ensure that a sensor takes a reading at approximately the same recurring position and to coordinate communication from the sensors to the local controller 690. For example, in the exemplary embodiment, can necking machine 10 is rated to operate at 3400 cans per minute. Accordingly, a can body passes each sensor 630 and 670 every 17 ms. Distributing local controllers 690 per stage enables the use of proven PLC's of the type and sophistication that are often used in plants making cans and/or necking can bodies yet are capable of keeping up with the data rates.

A main controller 680, such as, for example, an Allen-Bradley Contrologix style style PLC, interrogates each of the local controllers 690. Main controller 680 preferably stores the threshold limits and logic for making decisions in response to data relative to the threshold limits, processes historical data, and the like.

Accordingly, the embodiments disclosed herein may allow timely identification of a threshold crossing. For example, because each stage of a multi-stage can necking machine has a local controller, a local controller may be used to quickly identify a drop. A main controller may then be used to perform calculations, such as calculating drop rates for pockets, stages and the overall multi-stage can necking machine. Thus, a multi-stage can necking machine may be run at a fast rate because timely identification of a threshold crossing may be achieved by dividing functions between a local and main controller.

In one embodiment, it may be useful to set different threshold rates for various parts of the multi-stage can necking machine. For example, a threshold rate may be set at the pocket level. If a pocket drops cans over a certain rate the threshold rate for the pocket is crossed. A threshold rate may also be set for an individual stage of the multi-stage can necking machine (or any part of an individual stage, such as an individual turret or starwheel). If cans are dropped from the stage over a defined rate, then the threshold rate for the stage is crossed. In addition, a global threshold may be set for the overall multi-stage can necking machine. If, cumulative throughout the overall multi-stage can necking machine, cans are dropped over a predetermined rate, then the threshold rate for the multi-stage can necking machine is crossed.

Control actions relating to the multi-stage can necking machine may be taken if threshold rates are crossed. For example, if any of the threshold levels are crossed, the main controller may slow down or stop the multi-stage can necking machine. In a similar way, if drop rates are below certain thresholds the main controller may increase the speed of the multi-stage can necking machine.

The various thresholds may be independent of one another. For example, although no individual pocket may have crossed the pocket threshold rate, the threshold rate for a stage or for the overall multi-stage can necking machine may be crossed. Similarly, no individual pocket or stage may have crossed their threshold, however, the threshold rate for the overall multi-stage can necking machine may be crossed.

Main controller 680 may also provide can drop information. As an example, main controller 680 may provide can drop information to an operator of the multi-stage can necking machine through a Human Machine Interface. The main controller 680 may provide such information as what pocket or stage has crossed a threshold rate; or, if neither an individual pocket nor stage has crossed a threshold rate, that the overall multi-stage can necking machine has crossed a threshold rate. Further, the main controller 680 may identify a location or locations of drops associated with crossing a threshold rate. Locations that may be identified include but are not limited to: a pocket, a starwheel, a turret, an individual stage, multiple stages, an input station, a waxer station, a reforming station, a flanging station, a light testing station and the overall multi-stage can necking machine.

Referring again to FIG. 5 there may be several drive motors 106 associated with a multistage can necking machine. In a preferred embodiment, each drive motor 106 may typically be driven by a variable frequency AC drive (VFD) (not shown), allowing the drive motor 106 speed to be controlled by regulating the frequency of the voltage supplied to the drive motor 106. A control action, such as slowing down or stopping the drive motors 106, may be effected by reducing the frequency to drive motors 106. The main controller 680 may control a drive motor 106 by sending a signal to an associated VFD instructing the VFD to change the frequency of the voltage applied to drive motor 106.

If the frequency received by a drive motor 106 is lower than the frequency corresponding to the speed at which the drive motor 106 is rotating, the drive motor 106 will convert the rotational energy into electrical power and return it to the DC power bus of the variable frequency drive. The electrical power generated by the drive motor 106 may be dissipated as heat in a resistor, or, by using the power. For example, by coupling together the DC busses of the VFD's with those of ancillary functions associated with the multi-stage can necking machine (e.g., vacuum fans) excess rotational energy may be used to power ancillary functions.

When stopping drive motors 106, the output frequency of the variable speed drives may be reduced and the rotational energy may be converted to electrical power to drive the ancillary functions, which may be beneficial to maintain during stopping. In an emergency stop situation, the output frequency of VFD's may be rapidly reduced, and, the rotational energy of may still be converted to electrical power to drive the ancillary functions, which may be beneficial to maintain during emergency stopping.

The slowing and stopping may be described as a braking effect. A braking effect is created at each individual drive motor 106. Thus, by using multiple drive motors 106, a braking force is applied at multiple points along the length of the multi-stage can necking machine, reducing torque from what would be required if torque were applied only at a single point by a single motor or brake.

What is claimed is:

1. A method of controlling a multi-stage can-necking machine, the method comprising:

a) monitoring a first drop rate associated with a first stage of the multi-stage can necking machine, b) monitoring a second drop rate associated with a second stage of the multi-stage can necking machine;

c) monitoring a global drop rate associated with the multi-stage can necking machine;

d) determining if at least one of (i) the first drop rate crosses a predetermined first drop rate threshold, (ii) the second drop rate crosses a predetermined second drop rate threshold; and (iii) the global drop rate crosses a predetermined global drop rate threshold; and e) performing automatically at least one of slowing, or speeding up the multi-stage can necking machine upon crossing a threshold in the determining step (d).

2. The method of claim 1, further comprising identifying at least one of the first stage, the second stage or the multi-stage can necking machine if there is a determination that at least one of the first drop rate threshold, the second drop rate threshold or the global drop rate threshold has been crossed.

3. The method of claim 1, further comprising identifying, for every location where a drop occurred contributing to crossing a threshold, a drop location and at least one of an associated number of drops or an associated drop rate.

4. The method of claim 1, wherein the slowing, stopping or speeding up of the multi-stage can necking machine is implemented by varying a frequency of a voltage supplied to a drive motor.

5. The method of claim 4, wherein slowing or stopping the multi-stage can necking machine comprises generating electrical power.

6. The method of claim 1, wherein monitoring the first drop rate comprises monitoring every pocket in at least one of a turret or a transfer starwheel in the first stage and monitoring the second drop rate comprises monitoring every pocket in at least one of a turret or a transfer starwheel in the second stage.

7. The method of claim 1, wherein monitoring the first drop rate comprises monitoring every pocket in the first stage and monitoring the second drop rate comprises monitoring every pocket in the second stage.

8. A system to control a multi-stage can-necking machine, the system comprising:

a first plurality of sensors associated with a first stage of the multi-stage can-necking machine and a second plurality of sensors associated with a second stage of the multi-stage can-necking machine; and a first local controller associated with the first stage of the multi-stage can-necking machine and a second local controller associated with the second stage of the multi-stage can-necking machine; and a main controller, wherein (i) the main controller individually communicates with both the first local controller and the second local controller, and (ii) the main controller automatically slows down or speeds up the multi-stage can necking machine based on the communications from the first and second local controllers.

9. The system of claim 8, wherein each sensor transmits data indicating whether an associated pocket has dropped a can.

10. The system of claim 9, wherein the first local controller receives data from the first plurality of sensors and the second local controller receives data from the second plurality of sensors.

11. The system of claim 10, wherein the main controller receives data from the first local controller and the second local controller.

12. The system of claim 11, wherein the main controller slows, stops or speeds up the multi-stage can-necking machine if at least one of a pocket drop rate threshold, a stage drop rate threshold or a global drop rate threshold has been crossed.

13. The system of claim 11, wherein the main controller slows, stops or speeds up the multi-stage can-necking machine if any combination of a pocket drop rate threshold crossing, a stage drop rate threshold crossing or a global drop rate threshold crossing occurs.

14. The system of claim 12, wherein the main controller identifies a pocket if a pocket drop rate threshold is crossed.

15. The system of claim 12, wherein the main controller identifies a stage if a stage drop rate threshold is crossed.

16. The system of claim 12, wherein the main controller identifies all pockets that have dropped cans if the global drop rate threshold was crossed, wherein the identifying is of drops that contributed to crossing the global drop rate threshold.

17. The system of claim 12, wherein slowing or stopping of the multi-stage can-necking machine is implemented by varying a frequency of a voltage supplied to a drive motor.

18. The system of claim 17, wherein slowing or stopping the multi-stage can necking machine comprises generating electrical power.

* * * * *